US010192728B2

(12) United States Patent
Zhang et al.

(10) Patent No.: US 10,192,728 B2
(45) Date of Patent: Jan. 29, 2019

(54) MASS SPECTROMETER AND METHOD APPLIED THEREBY FOR REDUCING ION LOSS AND SUCCEEDING STAGE VACUUM LOAD

(71) Applicant: SHIMADZU CORPORATION, Kyoto-shi, Kyoto (JP)

(72) Inventors: Xiaoqiang Zhang, Shanghai (CN); Gongyu Jiang, Shanghai (CN); Yunqing Huang, Shanghai (CN); Jiaqi Shen, Shanghai (CN); Wenjian Sun, Shanghai (CN)

(73) Assignee: SHIMADZU CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/736,138

(22) PCT Filed: Jun. 20, 2016

(86) PCT No.: PCT/JP2016/002949

§ 371 (c)(1),
(2) Date: Dec. 13, 2017

(87) PCT Pub. No.: WO2017/006523

PCT Pub. Date: Jan. 12, 2017

(65) Prior Publication Data

US 2018/0174813 A1 Jun. 21, 2018

(30) Foreign Application Priority Data

Jul. 9, 2015 (CN) ..... 2015 1 0400591

(51) Int. Cl.
*H01J 49/00* (2006.01)
*H01J 49/06* (2006.01)
(Continued)

(52) U.S. Cl.
CPC ..... *H01J 49/067* (2013.01); *H01J 49/0404* (2013.01); *H01J 49/10* (2013.01); *H01J 49/24* (2013.01); *H01J 49/26* (2013.01)

(58) Field of Classification Search
CPC ..... H01J 49/067; H01J 49/26; H01J 49/10; H01J 49/0404; H01J 49/24
(Continued)

(56) References Cited

U.S. PATENT DOCUMENTS 5,352,893 A 10/1994 Freedman
6,972,408 B1 12/2005 Reilly
(Continued)

FOREIGN PATENT DOCUMENTS

WO 0063949 A1 10/2000
WO 2014001827 A2 1/2014

OTHER PUBLICATIONS

International Search Report (ISR) issued by the European Patent Office (EPO) dated Sep. 16, 2016 for PCT/ JP2016/002949.
(Continued)

*Primary Examiner* — Michael Maskell
(74) *Attorney, Agent, or Firm* — Tim Tingkang Xia, Esq.; Locke Lord LLP

(57) ABSTRACT

The disclosure relates to a mass spectrometer and a method applied thereby for reducing ion loss and succeeding stage vacuum load. The mass spectrometer includes an ion source connected via vacuum interfaces, a vacuum chamber and a succeeding stage device; wherein a tubular lens is arranged above a Mach disc formed by a gas flow carrying ions at the vacuum interfaces, so that an ion transfer path is restrained and the ions scattering with the gas flow is reduced. In comparison to a sole reliance on a radio-frequency voltage for focusing ions, the efficiency of ion capture in a jet region is improved by using an aerodynamic lens; and the desol-
(Continued)

vation efficiency of electrically charged droplets is also improved, thereby further improving the sensitivity of the mass spectrometer. Meanwhile the tubular aerodynamic lens is simple in structure and small in size.

19 Claims, 7 Drawing Sheets

(51) Int. Cl.

| | |
|---|---|
| ***H01J 49/04*** | (2006.01) |
| ***H01J 49/24*** | (2006.01) |
| ***H01J 49/10*** | (2006.01) |
| ***H01J 49/26*** | (2006.01) |

(58) Field of Classification Search
USPC ..... 250/281, 282
See application file for complete search history.

(56) References Cited

U.S. PATENT DOCUMENTS

| | | | | |
|---|---|---|---|---|
| 7,259,371 | B2 | 8/2007 | Collings et al. | |
| 8,269,164 | B2 | 9/2012 | Finlay et al. | |
| 2004/0089803 | A1 | 5/2004 | Foley | |
| 2004/0188605 | A1 | 9/2004 | Tang et al. | |
| 2008/0116371 | A1 | 5/2008 | Wouters et al. | |
| 2009/0212210 | A1 | 8/2009 | Finlay et al. | |
| 2012/0056085 | A1 | 3/2012 | Giles et al. | |
| 2015/0034818 | A1* | 2/2015 | Ouyang ..... | H01J 49/0495 250/282 |

OTHER PUBLICATIONS

Wyttenbach, Thomas et al., "Design of a new electrospray ion mobility mass spectrometer", International Journal of Mass Spectrometry, vol. 212, Issue 1-3, pp. 13-23, Accepted: Jul. 14, 2001.

* cited by examiner

MASS SPECTROMETER AND METHOD APPLIED THEREBY FOR REDUCING ION LOSS AND SUCCEEDING STAGE VACUUM LOAD

FIELD OF THE INVENTION

The present invention relates to the technical field of mass spectrometry, in particular to a mass spectrometer and a method applied thereby for reducing ion loss and succeeding stage vacuum load.

BACKGROUND OF THE INVENTION

A mass analyzer for the mass spectrometer typically works under a certain vacuum degree. Suitable vacuum degree ranges from 10 mtorr to $10^{-10}$ torrbased on the type of the analyzer, such as an ion trap, a quadrupole rod, a time of flight type, a Fourier transform type, etc. If the ions to be analyzed are generated in a region of relatively high gas pressure, for example an atmospheric pressure region, a series of vacuum interfaces are required to form a pressure gradient so as to effectively transfer the ions to the region of the analyzer. From the atmospheric pressure to a succeeding stage vacuum (with the gas pressure typically between 10 mtorr and 100 torr), for example, commonly-used vacuum interfaces adopt capillaries, small holes, sampling cone holes and nozzles or the combination of the above. Ion guiding devices, which may be a plurality of multipole rods applying a radio-frequency voltage or stacked-ring electrode arrays or other variants, are typically arranged behind the interfaces for transferring the ions to a succeeding vacuum interface.

In an example of the gas pressure changing form the atmospheric pressure to 1 torr, if a capillary is used as the vacuum interface, gas flow in the capillary is accelerated due to a pressure drop. After being jetted from the capillary, the gas flow forms a supersonic free expanded jet due to a sudden pressure drop. The gas is first accelerated to several times of the sonic speed rapidly and then decelerated, and forms a so-called Mach disc at a position of one time of the sonic speed. Before the Mach disc (i.e., a supersonic region), the ions are constrained within the jet, but after the ions have passed through the Mach disc, severe ion scattering occurs. Therefore, if only a radio-frequency multipole or other optical devices is used for transferring or focusing the ions after the ions have passed through the Mach disc, and it is hard to achieve a high efficiency due to a high ion-scattering speed.

Based on the conventional solution to this problem, another sampling cone hole is used for capturing part of the ions before ion-scattering occurs, methods such as the radio-frequency multipole and the like may be used for focusing the ions transferred as no dramatic and sudden gas pressure change occurs, but the sampling efficiency is very low by adopting said method. Several methods or devices have been developed in recent years. One method, which is proposed in U.S. Pat. No. 7,259,371B2 by the inventor, is that the radio-frequency multipole or other radio-frequency devices are required to constrain or focus an ion beam before the Mach disc (i.e., the supersonic free jet region), thus the ions are already in the form of a relatively focused ion beam when passing through the Mach disc, and the scattering is greatly reduced. This method may improve the ion transfer efficiency, and therefore is adopted by many commercial instruments. However, this method also has the problems that no adjustment is made to the gas flow itself on the one hand, and the focusing effect of the radio-frequency voltage is very limited under the effect of high speed gas flow, so that it is hard to ensure no ion loss. On the other hand, in this method, the most effective radio-frequency voltage is in the form of a quadrupole field in order to ensure a better compressing effect of the ion beam. However, as for the ions of a wide mass range, it is necessary to scan the voltage or frequency of the quadrupole field to obtain the maximum transmission of the ions having different mass numbers. For a non-scanning type mass analyzer such as a time of flight mass spectrum, such a method limits the efficiency of analysis.

Another device is described in patent WO2014/001827A2. The inventor believes that the ion loss is due to ion scattering caused by occurrence of turbulence at a distal end of the free jet. Therefore, a long rectifier tube may be arranged in the direction of the free jet to cause the gas flow to change from the supersonic free jet to a uniform and regular laminar flow, and then the ions are transferred along the laminar flow, thereby avoiding scattering. ADC (Direct Current) voltage or the radio-frequency voltage may be applied to the rectifier tube at the same time to obtain a better constraint on the ion beam or achieve mobility separation, etc. In order to achieve a steady subsonic laminar flow, the device needs a rectifier tube having a typical length of about 100 mm. Obviously, such a long rectifier tube is undesirable for the miniaturization of the instrument, and the ion loss caused by a long-distance transfer will increase greatly.

U.S. Pat. No. 8,269,164B2 employs another way in which a de Lavel nozzle structure is used as the vacuum interface, which may restrain free expansion of the free jet to form a collimated gas flow that may reduce the ion scattering loss. This structure is simple and small. However, according to simulations and experiments performed by the inventor, this structure tends to form a uniform and high-speed gas flow whose speed is still two times as high as the sonic speed at a distance of 100 mm from an outlet of the nozzle. In such a strong flow field, it is difficult to effectively focus the ions by application of an electric field, and the high-speed gas flow will rush into a succeeding stage vacuum, adding to the burden placed upon the vacuum pump. Naturally, an ion guide and vacuum structure with an off-axis configuration is used for separating the ions from the gas flow so as to reduce the amount of the gas flow entering the succeeding stage vacuum axially. However, introduction of the off-axis configuration significantly adds the design complexity of the interface and easily causes a phenomenon of mass discrimination due to the difference in ion mobility of different ions.

SUMMARY OF THE INVENTION

In view of the above disadvantages of the prior art, the present invention aims to provide the improvement to vacuum interfaces in a mass spectrometer and reduce ion loss caused by following a free expanded jet without adding the succeeding stage vacuum load.

In order to achieve the foregoing and other related objects, the present invention provides the mass spectrometer comprising an ion source, a vacuum chamber, ion guiding devices and a hollow tubular lens; wherein the ion source is located in a first gas pressure region and provides ions, and the vacuum chamber is provided with an inlet and an outlet and is located in a second gas pressure region having a gas pressure lower than that of the first pressure region; ions in the first gas pressure region are allowed to pass through the inlet of the vacuum chamber and enter the vacuum chamber located in the second gas pressure region along with the gas flow generated by a pressure difference, and exit the vacuum chamber from the outlet of the vacuum chamber; the ion guiding devices are arranged in the vacuum chamber and located at the succeeding stage of the vacuum chamber inlet but a preceding stage of the vacuum chamber outlet; and the hollow tubular lens are arranged in the vacuum chamber and located at the succeeding stage of the vacuum chamber inlet but the preceding stage of the ion guiding devices; wherein the tubular lens adopts an aerodynamic lens whose central axis is parallel to a direction of the gas flow entering the vacuum chamber from the inlet of the vacuum chamber, the gas flow produces a Mach disc as a result of the free expanded jet after entering the vacuum chamber, and an inlet of the tubular lens is located at the upstream part of the Mach disc.

Alternatively, the free expanded gas flow is caused to form at least one vortex region at the downstream part of the Mach disc by the tubular lens.

Alternatively, the tubular lens lead the outer side of the free expanded gas flow to form a vortex sheath, and the vortex sheath starts from a tail end of the tubular lens in an axial direction.

Alternatively, the tubular lens is made of insulating material.

Alternatively, the tubular lens contains a metal electrode.

Alternatively, the metal electrode is a metal cylinder and applies a DC (Direct Current) voltage.

Alternatively, the metal electrode adopts a multipole and is applied with a radio-frequency voltage and the DC voltage. The multipole has an axis substantially coinciding with the central axis of the tubular lens.

Alternatively, the metal electrode is a stacked-ring electrode array distributed along the central axis of the tubular lens, and is applied with the radio-frequency voltage and the DC voltage.

Alternatively, the metal electrode is shared by the ion guiding devices.

Alternatively, the tubular lens has a length-to-diameter ratio ranging from 0.5 to 5.

Alternatively, a hollow part of the tubular lens has a diameter varying in the axial direction.

Alternatively, the hollow part of the tubular lens comprises one or more sections having a reduced diameter in the axial direction.

Alternatively, the vacuum chamber inlet or outlet adopts a capillary or a small hole or a sampling cone hole or a nozzle or a combination of the above.

Alternatively, a pressure ratio of the first gas pressure region to the second gas pressure region is greater than 2.

Alternatively, a ratio between a minimum inner diameter of the tubular lens and a minimum inner diameter of the tail end of the vacuum chamber inlet is anyone of the following ranges: (a) 1 to 2, (b) 2 to 4, (c)4 to 8 and (d)8 to 20.

Alternatively, a ratio between an axial distance from the tail end of the vacuum chamber inlet to the tail end of the tubular lens and an axial distance from the tail end of the vacuum chamber inlet to a first Mach disc therebehind is 1 to 2.

In order to achieve the above and other related objects, the present invention provides a method for reducing ion loss occurring with free expansion of a gas flow when the ions pass through vacuum interfaces of the mass spectrometer. The method comprises: providing the ion source which is located in the first gas pressure region and provides ions; providing the vacuum chamber located in the second gas pressure region having a gas pressure lower than that of the first gas pressure region, wherein the ions in the first gas pressure region are allowed to pass through the inlet of the vacuum chamber into the second gas pressure region located in the vacuum chamber with the gas flow generated by the pressure difference, and exit the vacuum chamber from an outlet of the vacuum chamber; providing the ion guiding devices arranged in the vacuum chamber and located at the succeeding stage of the vacuum chamber inlet but a preceding stage of the vacuum chamber outlet; and providing a hollow tubular lens arranged in the vacuum chamber and located at the succeeding stage of the vacuum chamber inlet but the preceding stage of the ion guiding devices, wherein the tubular lens is an aerodynamic lens whose central axis is parallel to the direction of the gas flow entering the vacuum chamber from the inlet of the vacuum chamber, the gas flow produces the Mach disc as a result of the free expanded jet after entering the vacuum chamber, and an inlet of the tubular lens is located at the upstream part of the Mach disc.

In order to achieve the above and other related objects, the present invention provides a method for reducing the vacuum load of a succeeding stage in a multistage vacuum structure of the mass spectrometer. In this method, a vortex sheath is formed at an outer side of the free expanded gas flow beam due to the tubular lens so as to effectively direct at least a part of a central gas flow beam towards an off-axis direction, thereby reducing the amount of the gas flow at a succeeding stage vacuum interface located in a paraxial region.

Compared with the prior art, the present invention has the following advantages as follows:

1. In comparison to a sole reliance on the radio-frequency voltage for focusing the ions, the efficiency of ion capture in a jet region may be improved by using the aerodynamic lens.

2. The tubular lens is simple in structure and small in size. Preferably, the size ranges from 0.1 to 10 mm in inner diameter and 1 to 15 mm in length.

3. For the most widely used electrospray ion source, the vortex region formed by the aerodynamic lens may not only improve the efficiency of ion capture, but also improve a desolvation efficiency of charged droplets, thereby further improving the sensitivity of the mass spectrometer.

4. It has been found that the amount of gas flow entering the succeeding stage vacuum may be reduced for the tubular lens of a specific size, thereby reducing the burden placed upon a succeeding stage vacuum pump, which is advantageous for the miniaturization of the mass spectrometer.

DETAILED DESCRIPTION OF THE INVENTION

The embodiments of the present invention will be explained by way of specific examples below, and other advantages and efficacy of the present invention will become apparent to the skilled in the art upon consideration of this disclosure in the specification. The present invention is capable of being practiced or carried out in other different ways, and its several details in the specification are susceptible of various modifications or changes based on different viewpoints and applications under the premise of according with the spirit of the present invention. It should be noted that, in case of no conflict, the embodiments of the present invention and the features of the embodiments may be combined with each other.

Figure 1:
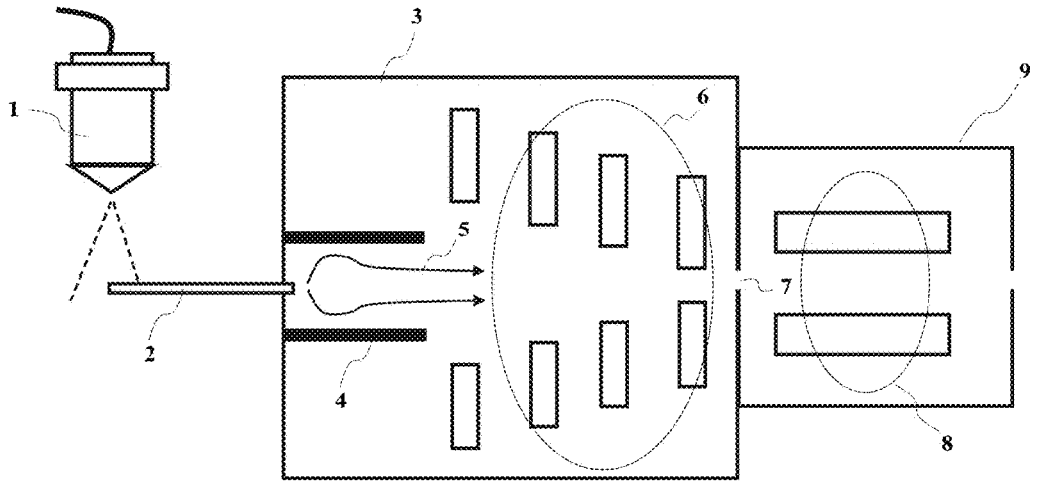
FIG. 1 is a structural schematic view of the mass spectrometer in one embodiment of the present invention.

The present invention is applicable to a device or system for mass spectrographic analysis, such as the mass spectrometer, etc. FIG. 1 is a preferred embodiment of the present invention. Ions generated by an ion source 1 (such as an electrospray ion source, etc.) under an atmospheric pressure enter a vacuum chamber 3 (such as an ion transport chamber in an ion guiding device) via a capillary 2. A typical gas pressure in the vacuum chamber 3 is 1 torr to 10 torr. As a gas flow generated by a pressure difference forms a free expanded supersonic jet when entering the vacuum chamber 3 via the capillary 2, the jet has substantially the profile of a concentric barrel shock extending in a direction of the capillary 2 if without any limitation. The gas flow may have a speed exceeding a sonic speed within shock waves. The gas flow experiences a speed drop to obtain a speed below the sonic speed when rushing over a Mach disc on a vertical plane. The gas flow slowed down becomes dispersed in the speed direction gradually due to collision with background gas, and the ions transferred by being carried in the gas flow will undergo a severe loss at the downstream part of the Mach disc.

Therefore in the embodiment of FIG. 1, in order to avoid this problem, the present invention uses a hollow tubular lens 4, which preferably is a aerodynamic lens, to restrain expansion of the jet, and an inlet of the aerodynamic lens 4 is located at the upstream part of the Mach disc. As will be described in detail below, a suitable selection of a geometric size of the lens may cause the gas flow to form one or more vortex regions behind the Mach disc for restraining an ion transport path, thereby reducing the scattering of the ions with the gas flow. A flow direction of the gas flow may simply be construed to be in the direction indicated by an arrow 5 in the figure after the adjustment by the aerodynamic lens 4, that is, the free expanded gas flow beam is restrained and rectified such that the ions will enter the ion guiding device 6 with the gas flow, be guided and focused, and enter a succeeding stage device 8 via a vacuum interface 7. The succeeding stage device 8 has a typical gas pressure of 1 mtorr to 200 mtorr, may be the ion guiding device or a mass analyzer, etc., and thus may be located in a succeeding stage vacuum chamber 9.

Figure 2A:
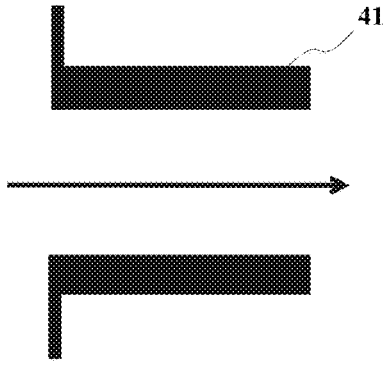
FIGS. 2*a* to 2*c* are structural schematic cross-section views of the tubular lenses in a plurality of the embodiments of the present invention.
Figure 2B:
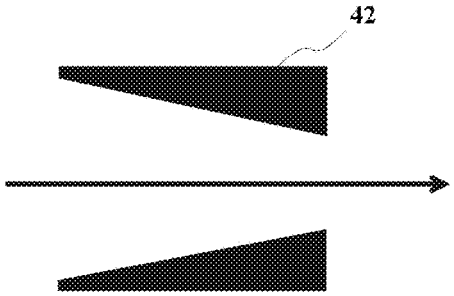
Figure 2C:
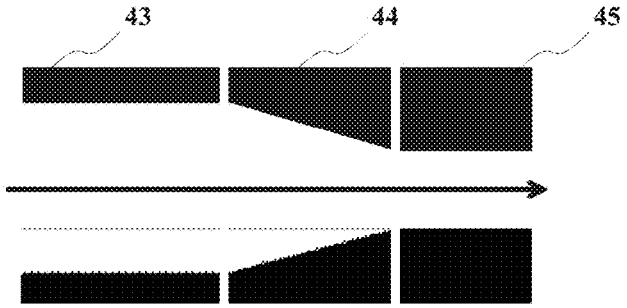

FIGS. 2*a* to 2*c* are cross-section views of several different geometric structures of the tubular aerodynamic lens 4. A lens 41 with a cylindrical structure as shown in FIG. 2*a* is most typical, and an inner hollow part thereof (or called tubular space) has a constant diameter in a length direction, and the gas flow direction is indicated by the arrow in the figure. Typically, the aerodynamic lens 41 has a diameter between 1 and 10 mm and a length between 1 and 15 mm, and its preferred size depends on the size of the capillary 2 and a gas pressure value in the vacuum chamber 3. For example, if a capillary having a length of 80 mm and an inner diameter of 0.6 mm is used and the pressure in the vacuum chamber 3 is 2 torr, and a tubular lens having a diameter of 5 to 10 mm and a length of 8 to 15 mm may be adopted.

Another structure is a funnel-shaped aerodynamic lens 42 as shown in FIG. 2*b*, the gas flow direction is in the arrow direction in the figure, and the inlet has a radius larger than that of the outlet. A typical size is that the inlet is 10 to 15 mm, the outlet is 4 to 10 mm, and the length is 8 to 20 mm. The funnel-shaped structure has the advantages that a stronger vortex can be formed within the shorter length, meanwhile, the larger inlet ensures that as many ions as possible are captured, and the smaller outlet may allow better focusing of the gas flow.

The embodiments in FIGS. 2*a* and 2*b* may also be combined to obtain another embodiment. For example, FIG. 2*c* shows a combination of structures of the above-mentioned straight tubular aerodynamic lens and the funnel-shaped aerodynamic lens. After sufficient expansion within the large-diameter straight tubular aerodynamic lens 43, the gas flow is restrained and rectified by the funnel-shaped aerodynamic lens 44, and then the focused gas flow is collimated by the small-diameter straight tubular aerodynamic lens 45. Compared with the collimated gas flow disclosed in the U.S. Pat. No. 8,269,164B2, the gas flow in this embodiment is much slower and thus may facilitate operation performed on the ions carried therein with the electric field, such as ion focusing, or pulling out of ions from the gas flow, or ion separation according to the mobility of the ions. It should be noted that, the aerodynamic lenses 43, 44 and 45 may be formed into an integrated one, or formed as a matched combination of a plurality of differently sized lenses.

Figure 3:
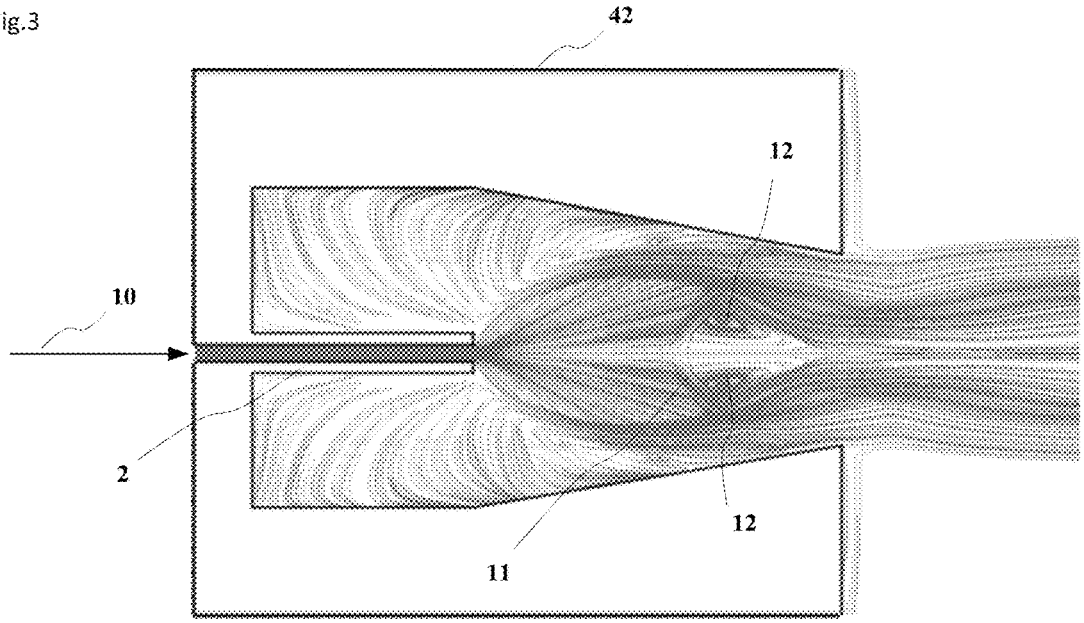
FIG. 3 is a schematic view of an simulation result of gas dynamic computer simulation performed after the use of the tubular lens in the embodiment of FIG. 2*b;*

FIG. 3 shows the results of gas dynamic simulation performed by the funnel-shaped aerodynamic lens in the embodiment of FIG. 2*b*. FIG. 3 is a cross-section view of velocity distribution of a gas flow field which is central symmetric along an axis. The gas flow enters a vacuum region with a gas pressure of, for example, 1.7 torr from the atmospheric pressure via the capillary 2 (not shown completely) in the direction of the arrow 10. The lens 42 is the funnel-shaped aerodynamic lens. Due to the restriction effect of the aerodynamic lens, a Mach disc 11 substantially vertical to the direction of the arrow 10 is compressed backwards in the free jet, thus two vortex regions 12 are formed behind the Mach disc 11, and the vortexes are in a clockwise and inward direction. The vortexes may cause effective deceleration and short residence of the ions when the ions pass through the regions, thereby not only preventing wall-collision loss of the ions, but also not creating a laminar flow excessively high in speed or unstable turbulence at the downstream part of the Mach disc. In the downstream vortex region, the flow rate of the gas flow drops rapidly, and the ions can be transferred and focused effectively by using a conventional ion guiding device. Other geometric structures as shown in FIG. 2*a* or 2*c* may also be used for creating similar vortexes as long as the size is suitable. In comparison with the prior art, one of the important differences and improvements of the present invention is the formation of the vortex regions.

In the above embodiment, a housing of the aerodynamic lens may be made of insulator material, such as engineering plastics, epoxy resin, etc. But metal is preferred to constitute a tubular electrode so as to add an electric field lens function on the basis of the aerodynamic lens for further facilitating ion transfer. For example, when the tubular metal electrode is selected, application of a DC potential different from that applied on the capillary 2 and the ion guiding device 6 is typically required so as to facilitate ion transfer.

In addition to the DC voltage, a radio-frequency or AC (Alternating Current) voltage of a certain amplitude and frequency may also be applied on the electrode of the tubular lens. It is emphasized that, the electrode of the tubular aerodynamic lens may be of various shapes and is not limited to the tubular shape.

Figure 4A:
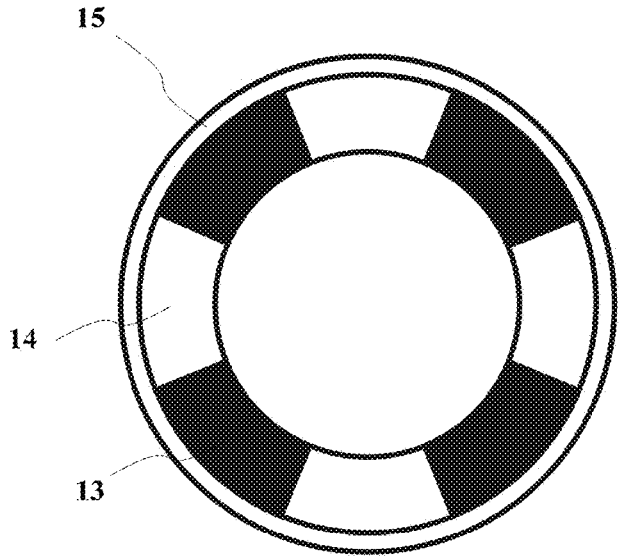
FIG. 4*a* is a structural schematic view of electrodes within the tubular lens in one embodiment of the present invention.
Figure 4B:
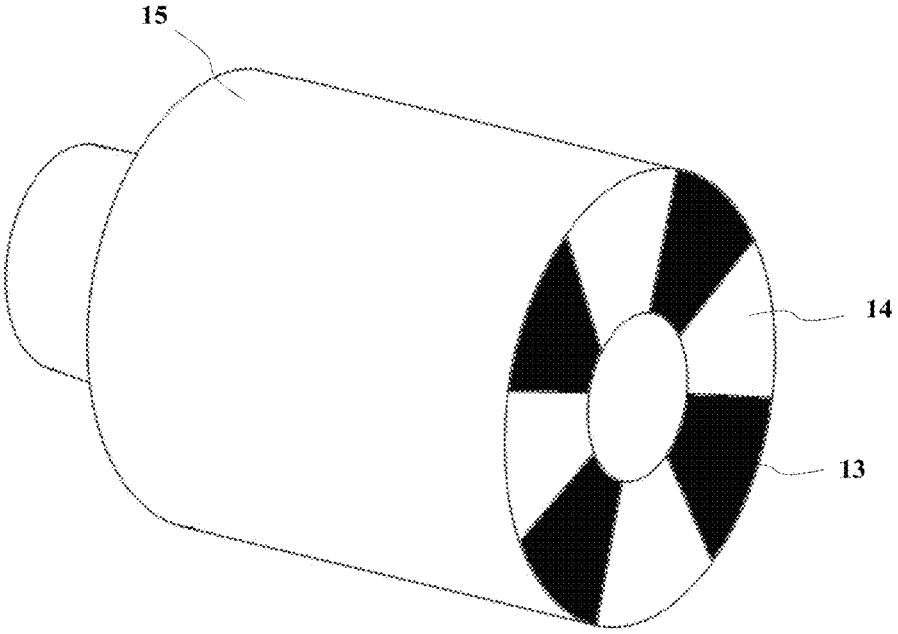
FIG. 4*b* is a schematic cross-section view of FIG. 4*a;*
Figure 4C:
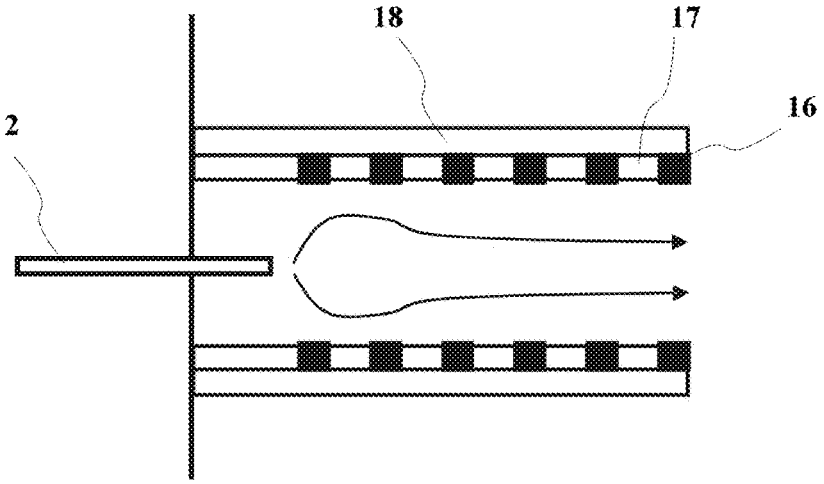
FIG. 4*c* is a structural schematic view of the electrodes within the tubular lens in another embodiment of the present invention.

FIGS. 4*a* and 4*b* present an electrode structure within the aerodynamic lens in one embodiment, and FIG. 4*c* presents another electrode structure within the aerodynamic lens.

FIGS. 4*a* and 4*b* present a quadrupole field electrode structure within the aerodynamic lens, wherein FIG. 4*a* is a schematic cross-section view vertical to an axial direction of the lens, and FIG. 4*b* is a schematic isometric view of the lens. As shown in figures, four electrodes 13 apply a radio-frequency voltage in the form of a quadrupole field, thus a radio-frequency quadrupole field may be formed inside the aerodynamic lens so as to allow a better compression of an ion beam. Strip-shaped insulating parts filled between the electrodes are designated by 14, which preferably are engineering plastics such as PEEK (Polyether ether ketone), etc. Inner surfaces of the electrodes 13 and the insulating parts 14 define a tubular space, and the insulating housing 15 shown in the figure serves as a support. Thus, the radio-frequency quadrupole field and the aerodynamic lens act together, avoiding the ion loss to the greatest extent possible. As described above, the tubular space defined by the individual electrodes may also have a diameter varying along the axis. For example, the size of each electrode and each insulating part may vary along the axis if the funnel shape shown in FIG. 2*b* is adopted.

By analogy with this embodiment, the radio-frequency electric field is not limited to the quadrupole field, and may also adopt a hexapole field, an octupole field, a dodecapole field, etc. A mass range wider than that obtained through the use of the quadrupole field can be obtained under the same radio-frequency condition by using a high-order field. Or a stacked-ring electrode array distributed in the axial direction is adopted. FIG. 4*c* shows a cross-section view of the tubular aerodynamic lens in the axial direction when the stacked-ring electrode array serves inside, in which the insulating housing 18 serves as the support, and the stacked-ring electrodes designated by 16 are staggered with respect to the annular insulating parts 17. A radio-frequency voltage of the same amplitude but opposite phase is applied between adjacent electrodes in the axial direction to constrain the ions, meanwhile, a specific DC gradient may be applied in the axial direction to push the ions or achieve some specific purposes, such as applying a reverse DC gradient to filter ions whose mobility is too high, etc.

Figure 5A:
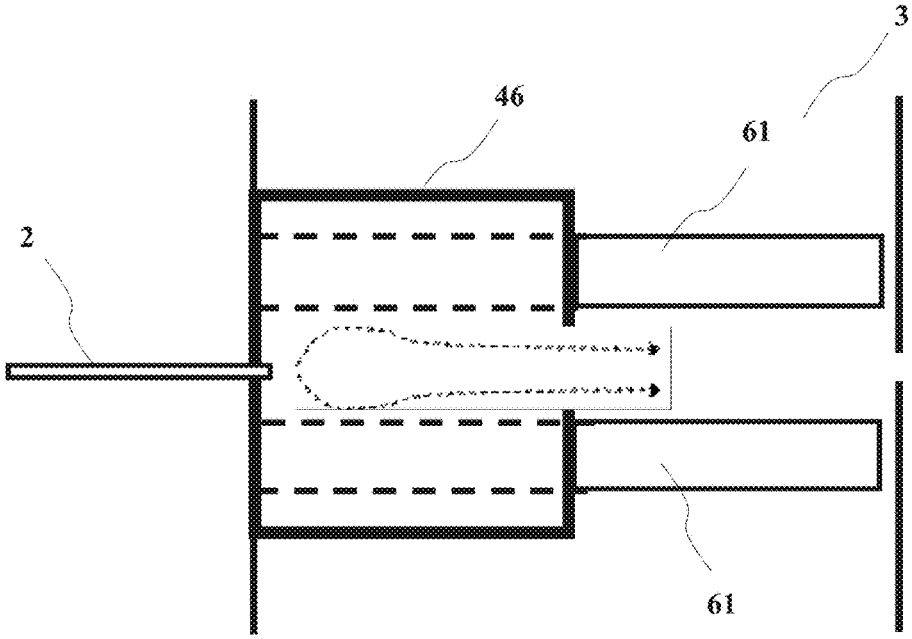
FIG. 5*a* is a structural schematic view of a combination of the electrodes within the tubular lens and ion guiding devices in one embodiment of the present invention.
Figure 5B:
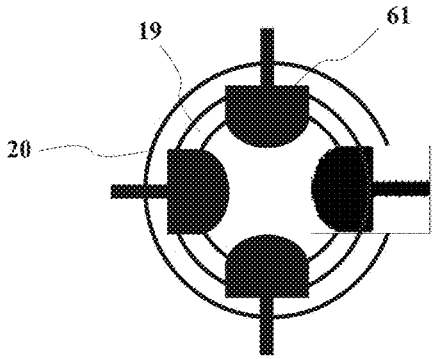
FIG. 5*b* is a schematic cross-section view of the tubular lens in FIG. 5*a;*
Figure 5C:
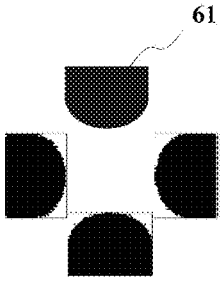
FIG. 5*c* is a schematic cross-section view of the ion guiding devices in FIG. 5*a;*

In one embodiment, the electrodes in the aerodynamic lens and the downstream ion guiding device 6 in FIG. 1 may be independent from each other or connected directly, or the electrodes in the aerodynamic lens may even be part of the electrodes in the ion guiding device. As shown in FIG. 5*a*, radio-frequency electrodes 61 in the ion guiding device extend into the aerodynamic lens 46 in the axial direction and form the radio-frequency quadrupole field within the lens 46 so as to focus and constrain the ions. In such a case, FIG. 5*b* is a cross-section view taken at the aerodynamic lens 46 in a direction vertical to the axial direction. In FIG. 5*b*, the parts of the four radio-frequency electrodes 61 within the aerodynamic lens 46 correspond to the electrodes 13 in the aerodynamic lens and form the quadrupole field. The parts of the electrodes 61 protruding outside of the insulating housing 20 are electrode connecting lines. The strip-shaped insulating parts 18 between the radio-frequency electrodes 61 may be equal to the insulating parts 14 in the above-mentioned embodiments. FIG. 5*c* is a cross-section view of the radio-frequency electrodes 61 taken outside the aerodynamic lens 46 (i.e., at the ion guiding device). The ions are exposed to the combined effects of the gas flow field and the radio-frequency electric field in the aerodynamic lens 46, and are focused and transferred by mainly relying upon the radio-frequency electric field after being emitted from the lens 46. Such a structure has two advantages, the first is that the whole structure and the voltage settings are simplified, and the second is that no jump occurs at the boundaries of the radio-frequency field within the tubular aerodynamic lens 46 and the radio-frequency field within the ion guiding device, thereby avoiding fringing field effects.

It should be noted that, in the embodiments of FIG. 4*a* or 5*a*, the electrodes in the tubular aerodynamic lens which form the multipole field are integrated electrodes (for example, a single whole strip) in the axial direction, but the practical application is not limited to this. The single whole strip may be segmented in the axial direction and applied with different DC voltages or radio-frequency voltages so as to form DC driving or adjust a pattern of the radio-frequency field. Or the DC gradient may also be formed by plating a high-resistance thin film on an outer side of the electrode in the axial direction.

With regard to the insulating parts 14 and 17 in the embodiments of FIGS. 4*a* to 4*c*, surface charge accumulation is not a severe problem due to presence of the strong gas flow field. Moreover, a variety of means may be adopted to further reduce the surface charge accumulation. For example, the surface may be plated with a layer of the high-resistance thin film to conduct away the charges or be treated by coating an antistatic agent, etc., so that surface treatment may be carried out. Or, as shown in FIG. 5*b*, inner surfaces of the insulating parts 19 are led slightly lower than that of the electrodes 61 to reduce the chance that the electrically charged ions contact with the insulating surfaces; however, it should be ensured that the above-described gas flow field does not change significantly. Or, a ratio of the inner surfaces of the electrodes in the lens to the inner surfaces of the insulating parts is increased to reduce surface charges, etc.

Figure 6:
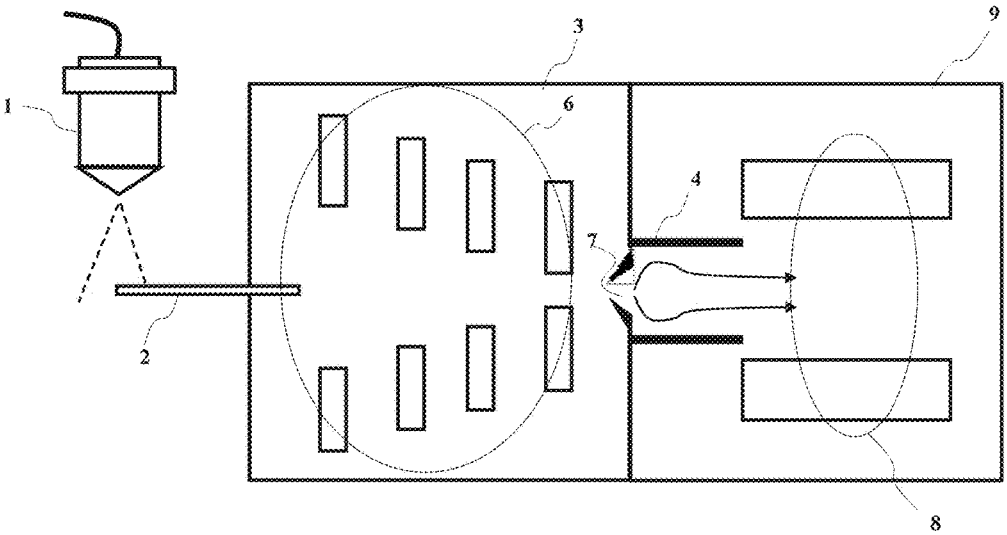
FIG. 6 is a structural schematic view of changes in location of the tubular lens in the mass spectrometer in another embodiment of the present invention.

FIG. 6 is another embodiment of the present invention, showing that the positions where the aerodynamic lens is located may also change. In this embodiment, the aerodynamic lens 47 is not located between the capillary 2 used as an atmospheric pressure interface and the ion guiding device 6, but between the succeeding stage vacuum interface 7 and the succeeding device 8 (the ion guiding device or the mass analyzer). The vacuum chamber 3 has a typical gas pressure of 1 to 10 torr, the succeeding stage device 8 has a typical gas pressure of 1 motrr to 200 mtorr, and at this time the vacuum interface 7 is preferably a circular aperture lens or the sampling cone hole. In this embodiment, there may be cases where the corresponding gas flow gradually changes from a continuous flow in the vacuum chamber 3 to a transition flow or even a molecular flow by entering the succeeding stage device 8 via the vacuum interface 7, but the aerodynamic lens 48 may still be used for adjusting the gas flow so as to obtain a maximum ion transfer efficiency, except that the geometric size needs to be optimized and adjusted accordingly. Basically, the aerodynamic lenses of the present invention are applicable to the cases of changing from the continuous flow to the continuous flow, or from the continuous flow to the transition flow, or from the continuous flow to the molecular flow via the transition flow, or from the transition flow to the molecular flow, but is not applicable to the case of changing from the molecular flow to the molecular flow. Therefore, in the multistage vacuum system, the aerodynamic lenses of the present invention may be used on different vacuum interfaces separately or sequentially.

Moreover it should be pointed out that, for the mass spectrometer comprising a plurality of vacuum stages, the succeeding stage vacuum load of the vacuum chamber in which the aerodynamic lenses are located may also be reduced significantly, and some other vacuum gas pressure control effects may be obtained by setting the structures and location parameters of the aerodynamic lenses particularly.

Figure 7:
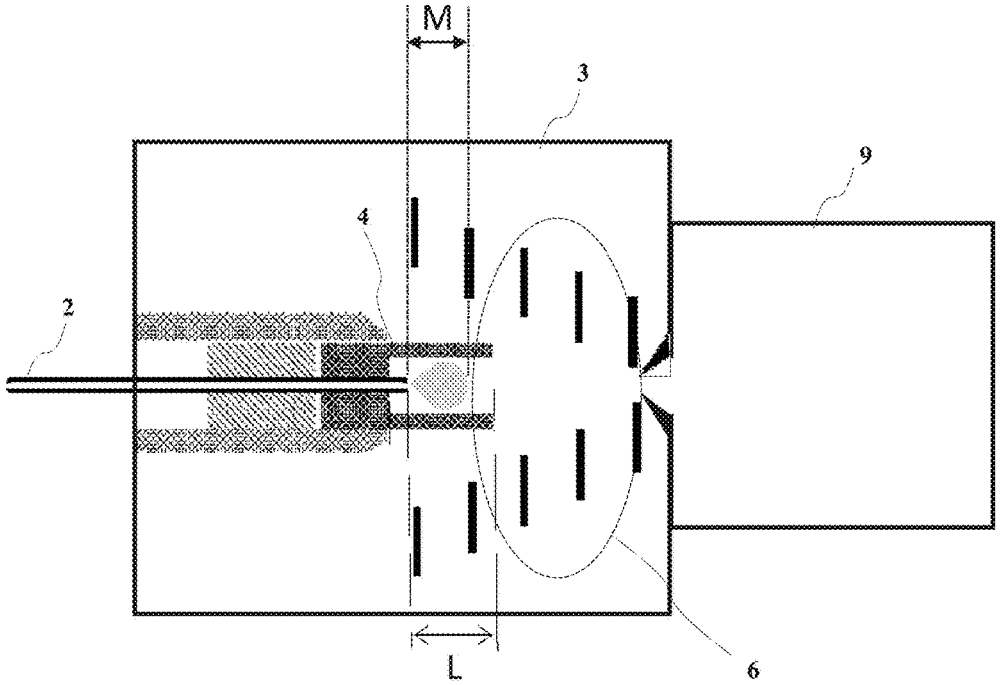
FIG. 7 is a structural schematic view of gas pressure control of the succeeding stage vacuum chamber performed by the mass spectrometer via the tubular lens in one embodiment of the present invention.
Figure 8A:
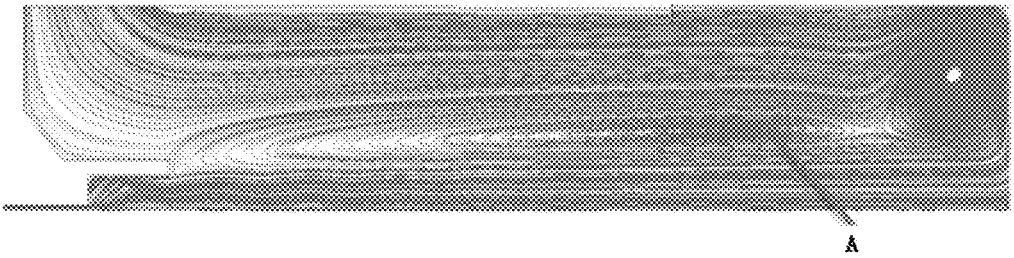
FIGS. 8*a* and 8*b* are simulation result views of gas dynamic computer simulation performed with and without the use of the tubular lens, respectively.
Figure 8B:
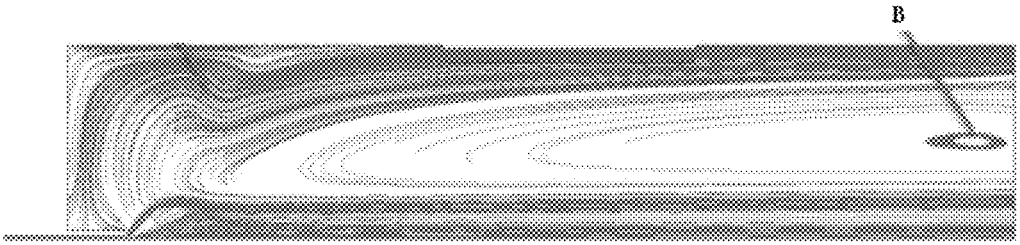
Figure 9:
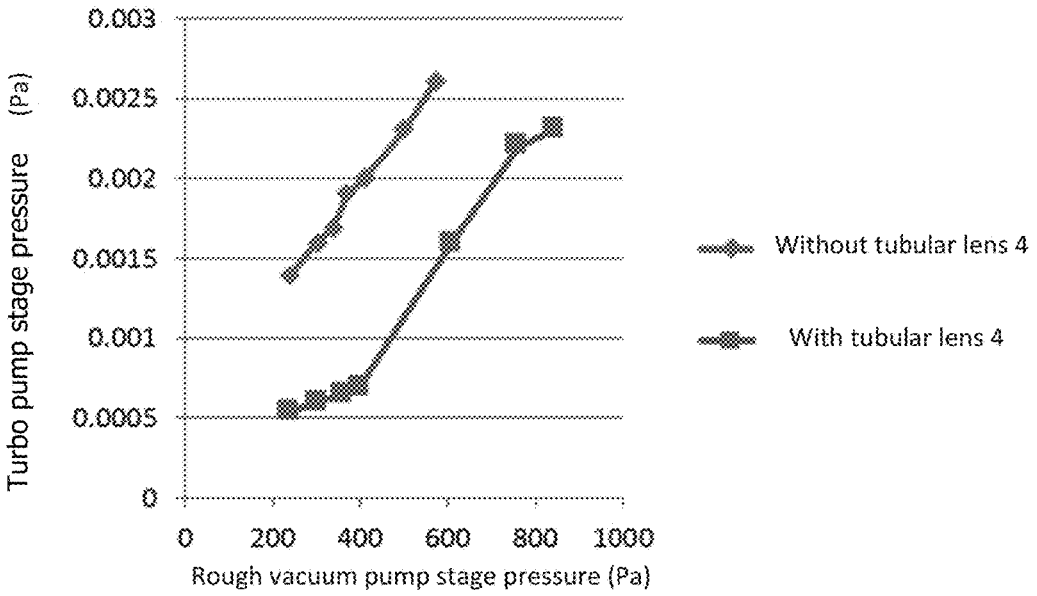
FIG. 9 is a graph comparing experimental results of a relationship between a rough vacuum pump stage pressure and a high-vacuum molecular pump evacuation stage pressure with and without the use of the tubular lens.

FIG. 7 presents a method for controlling the succeeding stage vacuum degree through the aerodynamic lens of the present invention. Wherein, a ratio of an axial distance L from the tail end of the vacuum chamber inlet to the tail end of the aerodynamic lens 4 and an axial distance M from the tail end of the vacuum chamber inlet to the first Mach disc therebehind is 1 to 2. With this structure, the axial gas flow decelerating suddenly behind the Mach disc diverges behind the tail end of the aerodynamic lens 4. The diverged gas flow decelerates to form a huge vortex sheath located on an outer side of a main gas flow beam due to loss of wall surface constraint of the structure of the aerodynamic lens 4. The vortex sheath is much stronger in scale and size than that of the structure without the aerodynamic lens 4, thereby leading a part of the main gas flow beam to the outer side in an off-axis manner, and reducing the flow rate and a gas flow density of the main gas flow beam. Thus, the gas flow introduced into the succeeding stage device 8 (having a high vacuum chamber formed through the molecular pump) via the vacuum interface 7 on the axis under the same gas pressure of the vacuum chamber 3 reduces significantly, thereby effectively decreasing the vacuum gas pressure of the succeeding stage device 8. Its principle is shown in FIG. 8*a*. According to this principle, the main gas flow beam is much wider obviously as compared with the flow field (in FIG. 8*b*) of the structure not using the aerodynamic lens, the vortex is much larger (see a comparison between the vortexes A and B in the figure), and lateral diversion of the gas flow due to the vortexes may be observed at the distal end. FIG. 9 is a view of experimental data showing effects of the aerodynamic lens of the present invention on vacuum degree decrease of a turbopump stage of the succeeding stage turbopump. In particular, when the existing capillary interface has a size of 0.5 mm (the inner diameter)×84 mm (the length) and the aerodynamic lens is 5 mm in length and 2.5 mm in inner diameter, and when a preceding stage adopts a preferred operating gas pressure of 300 Pa, the gas pressure of a pumping stage of the succeeding stage turbo pump may decrease by 3-fold or more at most. This means that the mass spectrographic analysis device or system with such a structure may employ a cheap or small turbopump with a lower pumping speed. It should be noted that, when the ratio of the minimum inner diameter of the aerodynamic lens to the minimum inner diameter of the tail end of the vacuum inlet is 1 to 20, such a vortex structure may appear; when the ratio is greater than 2, the pressure of the succeeding stage vacuum shows a clearly decreasing trend; and when this ratio is 4 to 8, a best pressure decreasing effect may be obtained comparatively.

Compared with the prior art, the present invention has the advantages as follows:

1. In comparison to sole reliance on the radio-frequency voltage for focusing the ions, the efficiency of ion capture in the jet region may be improved by using the aerodynamic lens.

2. The tubular lens is simple in structure and small in size. Preferably, the size is 0.1 to 10 mm in inner diameter and 1 to 15 mm in length.

3. For the most widely used electrospray ion source, the vortex region formed by the aerodynamic lens may not only improve the efficiency of ion capture, but also improve the desolvation efficiency of electrically charged droplets, thereby further improving the sensitivity of the mass spectrometer.

4. It has been found that the amount of gas flow entering the succeeding stage vacuum may be reduced for the tubular lens of a specific size, thereby reducing the burden placed upon a succeeding stage vacuum pump, which is advantageous for miniaturization of the mass spectrometer.

The above embodiments exemplarily illustrate of the principles of the present invention and the efficacy thereof merely, but not to limit the invention. Modification or changes are acceptable to the above embodiments by the skilled in the art without departing from the spirit and scope of the invention. Therefore, all equivalent modifications or changes accomplished by the skilled in the art having common knowledge without departing from the spirit and technical concept disclosed by the invention are intended to be encompassed by the following claims.

What is claimed is:

1. A mass spectrometer, comprising:

an ion source, located in a first gas pressure region and providing ions;

a vacuum chamber, having an inlet and an outlet and located in a second gas pressure region having a gas pressure lower than that of said first gas pressure region; wherein ions in said first gas pressure region are allowed to pass through said inlet of said vacuum chamber and enter said vacuum chamber located in said second gas pressure region along with a gas flow generated by a pressure difference, and exit said vacuum chamber from said outlet of said vacuum chamber;

an ion guiding device, arranged in said vacuum chamber and located at a succeeding stage of said vacuum chamber inlet but a preceding stage of said vacuum chamber outlet; and a hollow tubular lens, arranged in said vacuum chamber and located at said succeeding stage of said vacuum chamber inlet but said preceding stage of said ion guiding device;

wherein said tubular lens is an aerodynamic lens whose central axis is parallel to a direction of said gas flow entering said vacuum chamber from said inlet of said vacuum chamber, said gas flow produces a Mach disc as a result of a free expanded jet after entering said vacuum chamber, and the inlet of said tubular lens is located at the upstream part of said Mach disc.

2. The mass spectrometer according to claim 1, characterized in that said free expanded gas flow is caused to form at least one vortex region at the downstream part of said Mach disc by said tubular lens.

3. The mass spectrometer according to claim 1, characterized in that said tubular lens lead the outer side of said free expanded gas flow to form a vortex sheath, and said vortex sheath starts from an axial tail end of said tubular lens.

4. The mass spectrometer according to claim 1, characterized in that said tubular lens is made of insulating material.

5. The mass spectrometer according to claim 1, characterized in that said tubular lens contains a metal electrode.

6. The mass spectrometer according to claim 5, characterized in that said metal electrode is a metal cylinder and is applied with a DC voltage.

7. The mass spectrometer according to claim 5, characterized in that said metal electrode is a multipole and is applied with a radio-frequency voltage and the DC voltage, and said multipole has an axis substantially coinciding with said central axis of the tubular lens.

8. The mass spectrometer according to claim 5, characterized in that said metal electrode is a stacked-ring electrode array distributed along said central axis of said tubular lens, and is applied with the radio-frequency voltage and the DC voltage.

9. The mass spectrometer according to claim 5, characterized in that said metal electrode is a part of said ion guiding device.

10. The mass spectrometer according to claim 1, characterized in that said tubular lens has a length-to-diameter ratio ranging from 0.5 to 5.

11. The mass spectrometer according to claim 1, characterized in that a hollow part of said tubular lens has a diameter varying in an axial direction.

12. The mass spectrometer according to claim 11, characterized in that said hollow part of said tubular lens comprises one or more sections having a reduced diameter in the axial direction.

13. The mass spectrometer according to claim 1, characterized in that said vacuum chamber inlet or outlet is a capillary or a small hole or a sampling cone hole or a nozzle or a combination of the above.

14. The mass spectrometer according to claim 1, characterized in that a pressure ratio of said first gas pressure region to said second gas pressure region is greater than 2.

15. The mass spectrometer according to claim 1, characterized in that a ratio between a minimum inner diameter of said tubular lens and a minimum inner diameter of a tail end of said vacuum chamber inlet is anyone of the following ranges: (a)1 to 2, (b)2 to 4, (c)4 to 8 and (d)8 to 20.

16. The mass spectrometer according to claim 1, characterized in that a ratio between an axial distance from the tail end of said vacuum chamber inlet to the tail end of said tubular lens and the axial distance from the tail end of said vacuum chamber inlet to a first Mach disc therebehind is 1 to 2.

17. A method for reducing ion loss occurring with free expansion of the gas flow when said ions pass through vacuum interfaces of the mass spectrometer, comprising:

providing an ion source which is located in the first gas pressure region and provides the ions;

providing the vacuum chamber located in the second gas pressure region having the gas pressure lower than that of said first gas pressure region, wherein the ions in said first gas pressure region are allowed to pass through the inlet of said vacuum chamber and enter said vacuum chamber located in said second gas pressure region along with said gas flow generated by a pressure difference, and exit said vacuum chamber from the outlet of said vacuum chamber;

providing the ion guiding device arranged in said vacuum chamber and located at the succeeding stage of said vacuum chamber inlet but the preceding stage of said vacuum chamber outlet; and providing the hollow tubular lens arranged in said vacuum chamber and located at the succeeding stage of said vacuum chamber inlet but the preceding stage of said ion guiding device, wherein said tubular lens is an aerodynamic lens whose central axis is parallel to the direction of said gas flow entering said vacuum chamber from said inlet of said vacuum chamber, said gas flow produces the Mach disc as a result of said free expanded jet after entering said vacuum chamber, and the inlet of said tubular lens is located at the upstream part of said Mach disc.

18. The method according to claim 17, characterized in that said free expanded gas flow is caused to form at least one vortex region at the downstream part of the Mach disc by said tubular lens.

19. A method for reducing the vacuum load of the succeeding stage in a multistage vacuum system of the mass spectrometer, characterized in that a vortex sheath is caused to form at on the outer side of a free expanded gas flow beam by said tubular lens of said mass spectrometer according to claim 1 so as to effectively direct at least a part of a central gas flow beam towards an off-axis direction, thereby reducing the amount of the gas flow at a succeeding stage vacuum interface located in a paraxial region.

* * * * *